US006099721A

United States Patent [19]

Goolsby et al.

[11] Patent Number: 6,099,721

[45] Date of Patent: Aug. 8, 2000

[54] USE OF MAGNETIC SEPARATION TO REMOVE NON-MAGNETIC, PARTICLES FROM FCC CATALYST

[75] Inventors: Terry L. Goolsby, Katy, Tex.; Howard F. Moore, Catlettsburg, Ky.

[73] Assignee: The M.W. Kellogg Company, Houston, Tex.

[21] Appl. No.: 09/022,942

[22] Filed: Feb. 12, 1998

Related U.S. Application Data

[60] Provisional application No. 60/037,686, Feb. 12, 1997, provisional application No. 60/037,688, Feb. 12, 1997, provisional application No. 60/038,818, Feb. 12, 1997, and provisional application No. 60/037,687, Feb. 12, 1997.

[51] Int. Cl.[7] ..... C10G 11/02

[52] U.S. Cl. ..... 208/120.01; 208/113; 208/121; 208/152; 208/161

[58] Field of Search ..... 208/113, 120.01, 208/121, 152, 161

[56] References Cited

U.S. PATENT DOCUMENTS

| | | | |
|---|---|---|---|
| Re. 31,439 | 11/1983 | Rosensweig . | |
| Re. 35,046 | 10/1995 | Hettinger, Jr. et al. . | |
| 3,711,422 | 1/1973 | Johnson et al. . | |
| 4,359,379 | 11/1982 | Ushio et al. . | |
| 4,406,773 | 9/1983 | Hettinger, Jr. et al. . | |
| 4,482,450 | 11/1984 | Ushio et al. . | |
| 4,727,623 | 3/1988 | Thompson et al. . | |
| 4,784,748 | 11/1988 | Avidan et al. | 208/120 |
| 4,823,102 | 4/1989 | Cherian et al. . | |
| 4,882,043 | 11/1989 | Jung . | |
| 5,147,527 | 9/1992 | Hettinger . | |
| 5,171,424 | 12/1992 | Hettinger . | |
| 5,190,635 | 3/1993 | Hettinger . | |
| 5,198,098 | 3/1993 | Hettinger, Jr. . | |
| 5,230,869 | 7/1993 | Hettinger et al. . | |
| 5,250,482 | 10/1993 | Doctor . | |
| 5,328,594 | 7/1994 | Hettinger . | |
| 5,364,827 | 11/1994 | Hettinger et al. . | |
| 5,393,412 | 2/1995 | Hettinger . | |
| 5,448,803 | 9/1995 | Morell . | |
| 5,520,797 | 5/1996 | Ino et al. | 208/113 |
| 5,538,624 | 7/1996 | Hettinger . | |

*Primary Examiner*—Walter D. Griffin
*Assistant Examiner*—Tung Doan
*Attorney, Agent, or Firm*—Kellogg Brown & Root, Inc.

[57] ABSTRACT

A process for use of magnetic separation to remove non-magnetic particles from FCC catalyst is disclosed. A stream of circulating catalyst from a fluidized catalytic cracking (FCC) unit is charged to a magnetic separator. The catalyst is magnetically fractionated into at least three fractions, a high-metals fraction which is discarded, an intermediate-metals content fraction which is directly recycled to the FCC unit, and an inert, relatively magnetic metals-free fraction which is also discarded. Preferably, the high-metals fraction is immediately mixed with the inert, low-metals fraction, and the combined high-metals/inert fraction is pneumatically transmitted together to a spent catalyst storage facility for disposal.

20 Claims, 2 Drawing Sheets

USE OF MAGNETIC SEPARATION TO REMOVE NON-MAGNETIC, PARTICLES FROM FCC CATALYST

CROSS-REFERENCE TO RELATED APPLICATIONS

This application claims the benefit under 35 USC §119(e) of provisional U.S. Ser. Nos. 60/037,686, 60/037,687, 60/037,688, and 60/038,818, all filed Feb. 12, 1997, and all of which are incorporated by reference herein.

FIELD OF THE INVENTION

The present invention relates to the fluidized catalytic cracking (FCC) process and magnetic separation of FCC catalyst, and more particularly to aging of FCC catalyst so that the active catalyst is magnetically labeled, magnetically separated and returned to the FCC process while the non-magnetic particles are removed from the FCC process along with very magnetic particles comprising old, less active catalyst particles.

BACKGROUND OF THE INVENTION

Magnetic separation of metals-contaminated equlibrium catalyst (ECat) from ECat particles having a lower metal content was recently commercialized. Aspects of this process are disclosed in one or more of U.S. Pat. No. 4,406,773 to Hettinger, Jr. et al.; U.S. Pat. No. Re. 35,046 to Hettinger, Jr. et al.; U.S. Pat. No. 5,147,527 to Hettinger, Jr. et al.; U.S. Pat. No. 5,171,424 to Hettinger; U.S. Pat. No. 5,190,635 to Hettinger; U.S. Pat. No. 5,198,098 to Hettinger, Jr.; U.S. Pat. No. 5,230,869 to Hettinger et al.; U.S Pat. No. 5,328,594 to Hettinger; U.S. Pat. No. 5,364,827 to Hettinger et al.; U.S. Pat. No. 5,393,412 to Hettinger; and U.S. Pat. No. 5,538,624 to Hettinger; all of which are hereby incorporated by reference.

Some other work has been done in the area of magnetic separation of FCC catalyst. U.S. Pat. No. 5,250,482, to Doctor, used a super-cooled, quadrupole open-gradient magnetic separation system to separate ECat having more than about 2000 ppm nickel equivalents from ECat having less about 2000 ppm nickel equivalents. The patentee reported an anomaly, namely that the relatively low-metal catalyst "that is the material having less than about 2000 ppm nickel equivalent . . . " was not as active as the higher metal catalyst. The differences reported in metals levels were not large. Low susceptibility catalyst had 2022 ppm nickel equivalents while high susceptibility catalyst had 2261 nickel equivalents ppm. The patentee taught sending the low susceptibility material to a reducing zone, and from there back to the FCC reactor. The teachings of the '482 patent can be summarized as follows:

(1) use the Hettinger magnetic separation process to remove at least the highest metal-containing material (10,000 ppm plus nickel equivalents);

(2) separate the remaining catalyst into a 2000–6000 ppm fraction and a 2000 minus ppm nickel equivalents fraction;

(3) recycle the 2000–6000 ppm material directly to the FCC process;

(4) treat the 2000 minus nickel equivalent material to enhance catalytic activity and recycle the treated material to the reactor.

There remains a need in the art for a better way of processing or retaining the active catalyst from the 2000 minus nickel fraction, and/or for recovering the active catalyst from the 2000 minus nickel fraction with the 2000–6000 ppm nickel fraction. As far as applicants are aware, there is no teaching or suggestion in the prior art of a process which tags the active catalyst so that most of it is retained in the 2000–6000 ppm nickel fraction, leaving mainly inactive particles in the 2000 ppm minus nickel fraction.

SUMMARY OF THE INVENTION

According to the present invention, the catalyst circulating in an FCC unit is recirculated in the unit for an average residence time which is sufficient to allow the magnetic metals content of the active catalyst particles to build up to a level which will allow the active particles to have a high enough metals content to allow them to be separated magnetically from an inert particle fraction with little or no magnetic metal buildup.

In one aspect, the present invention provides a process for fluidized catalytic cracking (FCC) of a metals-contaminated hydrocarbon feed to lighter products. The process comprises the steps of:

a) mixing a metals-contaminated, crackable hydrocarbon feed with a source of hot regenerated catalyst in a cracking reaction zone of an FCC unit to produce a mixture of cracked products and spent catalyst containing metals deposited on the catalyst during the cracking reaction;

b) separating the spent catalyst from the cracked products;

c) removing the cracked products from the FCC process;

d) stripping the spent catalyst in a catalyst stripping zone by contact with stripping vapor to remove strippable hydrocarbons from the spent catalyst and produce stripped catalyst;

e) regenerating the stripped catalyst at catalyst regeneration conditions by contact with oxygen or an oxygen-containing gas to produce regenerated, metals-contaminated catalyst which is recycled to the cracking reaction zone;

f) recirculating the catalyst through steps (a) through (e) for an average residence time effective to build up a magnetic metals content in active catalyst particles so that a majority of the active catalyst has an intermediate to low magnetic metals content;

g) at least periodically removing a fraction of catalyst particles from the FCC unit and replacing the removed fraction with catalyst comprising a majority of catalytically active particles and a minority of relatively inert particles having less than 1/10th the cracking activity of the active catalyst; and h) magnetically separating the removed fraction into:

1) a high-metals fraction containing a relatively high-metals catalyst fraction which is removed from the unit and discarded;

2) an intermediate to low metals fraction which is recycled to the unit; and 3) an inert fraction having a particle size greater than 100 mesh which is removed from the unit and discarded.

In another aspect, the present invention provides an improvement in a process for fluidized catalytic cracking (FCC) of a metals-contaminated hydrocarbon feed to lighter products. The process comprises the steps of (a) mixing a metals-contaminated, crackable hydrocarbon feed with a source of hot regenerated catalyst in a cracking reaction zone to produce a mixture of cracked products and spent catalyst containing metals deposited on the catalyst during the cracking reaction, (b) separating the spent catalyst from the cracked products, (c) removing the cracked products from the process, (d) stripping spent catalyst in a catalyst stripping zone by contact with stripping vapor to remove strippable hydrocarbons from the spent catalyst and produce stripped catalyst, (e) regenerating the stripped catalyst at catalyst regeneration conditions by contact with oxygen or an oxygen-containing gas to produce regenerated, metals-contaminated catalyst which is recycled to the cracking reaction zone, (f) recirculating the catalyst in the FCC unit for an average residence time, (g) at least periodically removing a fraction of catalyst particles from the FCC unit and replacing the removed fraction with catalyst comprising a majority of catalytically active particles and a minority of relatively inert particles having less than 1/10th the cracking activity of the active catalyst, and (h) magnetically separating the removed fraction into (i) a high-metals fraction containing a relatively high-metals catalyst fraction which is removed from the unit and discarded, and (ii) an intermediate to low metals fraction which is recycled to the unit. The improvement provides that: (1) the residence time in the recirculating catalyst in step (f) is effective to build up a magnetic metals content in active catalyst particles so that a majority of the active catalyst has an intermediate to low metals content; (2) the intermediate to low metals fraction is recycled to the FCC unit without further treatment; and (3) an inert fraction having a particle size greater than 100 mesh is separated in step (h) and removed from the unit and discarded.

Preferably, at least a majority of the inert fraction in the process and improvement of the present invention has a particle size in excess of 176 microns. The inert fraction preferably comprises at least 80% of the inactive particles in the magnetically separated fraction. The high metals fraction which is discarded preferably has a total nickel and vanadium content of at least 6000 ppm, and the intermediate to low metals fraction preferably has a lower metals content than the high metals discard fraction. The average residence time of the recirculating catalyst is preferably at least 5 days, more preferably between 10 and 30 days. The intermediate fraction can be recycled directly to the FCC unit. The high metals fraction and the inert fraction can be combined to form a discard fraction comprising a mixture of the high metals fraction and the inert fraction. The mixed discard fraction can be pneumatically transported to a catalyst disposal means.

DETAILED DESCRIPTION OF THE INVENTION

Figure 1:
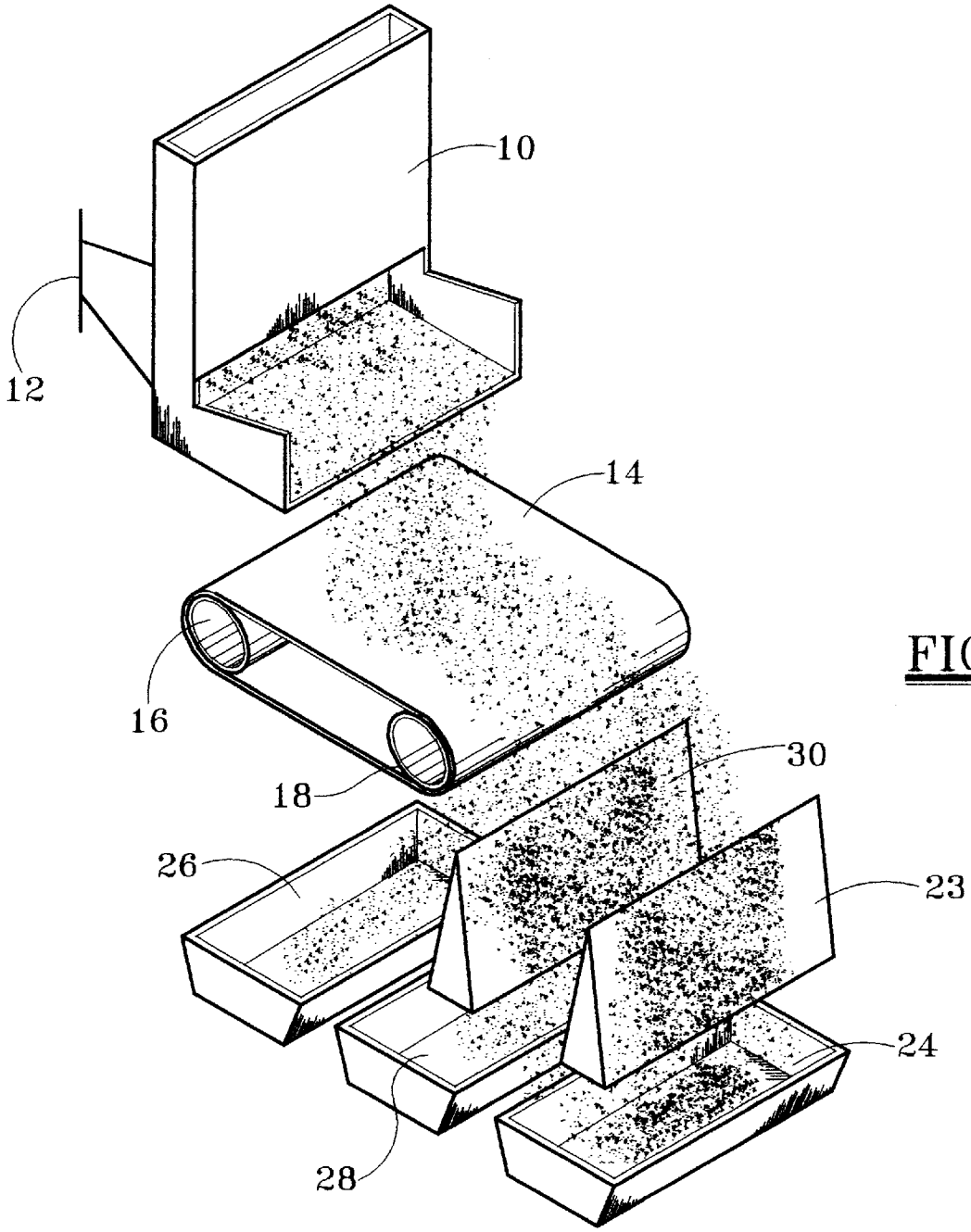
FIG. 1 is a simplified view of a preferred magnetic separator.
Figure 2:
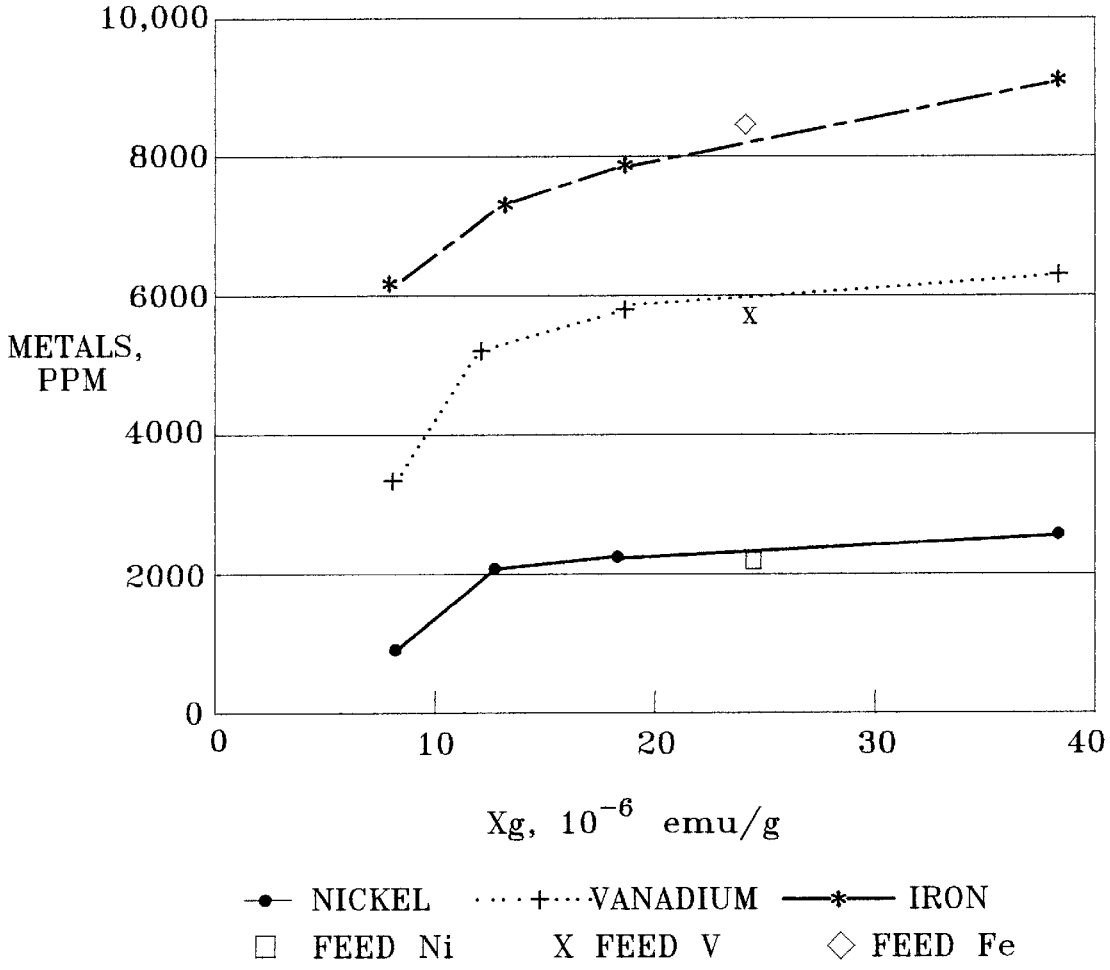
FIG. 2 is a plot of metals content versus magnetic susceptibility of catalyst withdrawn from an FCC unit

In the course of our work in developing and testing a magnetic separation process at a refinery fluidized catalytic cracking (FCC) unit, we learned some surprising new things about the equilibrium catalyst (ECat) in a commercial FCC unit. We confirmed that the very highest metals level material is severely metal-contaminated and should be discarded. We also confirmed that the fraction containing only a moderate metals level is active catalyst and should be recycled.

We found minor but significant amounts of inert material in the ECat. This material has little in the way of metals content or catalyst activity. It is almost inert. There is little zeolite or even amorphous catalyst activity in evidence. By the terms "inert" and "inactive" it is meant that the catalyst has an MAT gasoline selectivity less than 40 volume percent per ASTM D-3907-87, preferably less than 20 volume percent. It is believed that this lack of catalytic activity causes the low levels of magnetic metal deposition.

The best thing to do with this inert fraction is to discard it. It cannot be regenerated or rejuvenated by any known means to have significant catalyst activity. It adds nothing to the process, but occupies reactor volume in the FCC unit that could be more profitably used by active cracking catalyst.

We are able to use the magnetic separation process to almost completely remove this non-magnetic and essentially catalytically inert material from the process. The active FCC catalyst needs to be tagged or labeled for retention in the magnetic separation process, and feed metals or added magnetic hooks help to retain rather than reject active catalyst. The way to achieve this is to limit the amount of ECat sent to the magnetic separation unit so that the catalyst has an average residence time of at least 5 days in the FCC unit, preferably on the order of 10–30 days before it is sent to the magnetic separation unit. We allow the active catalyst to circulate in the FCC unit long enough to pick up enough metal to permit retention by a magnetic separator. We preferably build up enough metals, and/or have a strong enough magnetic field, so that at least 80% and preferably essentially all of the active catalyst is retained, while rejecting at least 80% of the essentially inert material.

There are several aspects to our discovery. The most surprising one is the presence of large amounts of inerts in the circulating ECat. It looks like catalyst, but has a particle size coarser than active catalyst and it is not active catalyst. The second is the discovery that active catalyst can pick up enough metals from the FCC feed so that most, and preferably on the order of 80–90% plus, more preferably at least 95% and especially above 99%, of the catalyst having a residence time of 5 days or more in the unit, can be retained in the magnetic field.

We also learned that all catalyst which is retained by magnetic separation can, after removal of the seriously metal-contaminated material, be directly recycled to the FCC unit. There is no need for hydrogen reduction or chemical treatment of any kind. Thus we are able to avoid costly additional processing steps.

We found a way to reduce the cost of discarding the various fractions obtained from the magnetic separation unit by combining them at the unit. We mix the highest metals reject fraction with the inert fraction. We discharge both via gravity feed into a common transfer vessel, and pneumatically transport the mixture to the spent catalyst collection facility. This "mix and more" approach eliminates a lock hopper and a transport means, simplifies the construction of the catalyst disposal system, and reduces the cost of the magnetic separation unit. While the cost savings of combined catalyst disposal are significant and worth achieving in a commercial unit, they are minor compared to the benefits of removing inert particles from the circulating ECat.

The magnetic separation unit is preferably placed close to the FCC unit with the majority of the unit contained within an adjacent steel structure. The structure houses the catalyst hopper, filters, catalyst water cooler, magnetic separator, bins, and catalyst transfer hoppers on various levels.

In the magnetic separator, catalyst is vibrated onto a belt in a thin layer as the belt rotates. The belt surrounds two rollers, one magnetic and one non-magnetic. The magnetic roller is motor driven, and the non-magnetic roller is a follower.

Referring now to FIG. 1, an abbreviated magnetic separator system is schematically illustrated. In practice, there is a feeder 10 which is vibrated by vibrator 12 to deposit catalyst particles on flexible continuous belt 14. Belt 14 may be of any type in use in the art although a belt made of woven aromatic polyamide fiber, such as KEVLAR, is preferred due to its durability and strength. In one preferred embodiment, a belt 14 approximately 10 mils thick is used, however, a belt 5 mils thick may also be used as indicated in the examples and data that follow below.

Belt 14 is stretched over follower roller 16 and leader roller 18. In one preferred embodiment, follower roller 16 is non-magnetic and functions primarily to provide a complete path for belt 14 to travel. Leader roller 18 is magnetic and is comprised of a plurality of disc shaped radial magnets preferably arranged in a bucking configuration and separated by spacers (not shown). The function of leader roller 18 is to establish a magnetic field by which catalyst particles having paramagnetic or ferromagnetic properties may be influenced. In practice, a stream of catalytic particles are placed on belt 14. As belt 14 rotates, the catalyst particles are carried forward at a belt 14 speed of preferably up to 340 feet per minute (fpm) and establish momentum. Paramagnetic impurities and ferromagnetic impurities that adhere to the catalyst particles are attracted to the magnets in leader roller 18 or are influenced by the magnetic field. Newly added catalyst particles or inert particles without a great amount of magnetic impurities would not be influenced as greatly by the magnetic field, and when the particles reach the end of belt 14, they continue with substantial momentum past the end of the roller 18 where belt 14 turns around and returns to the follower roller 16 where more catalyst particles are placed on belt 14. However, catalyst particles having a large amount of contamination, either through feedstock impurities or added ferromagnetic/paramagnetic "hooks", are drawn back to leader roller 18 due to magnetic attraction. Particles with little or no magnetic properties, preferably having a magnetic susceptibility less than $10\times10^{-6}$ emu/g, preferably less than $2\times10^{-6}$, and especially less than $1-10^{-6}$, are thus propelled by inertial forces past splitter 23 into a collection chute 24 which is horizontally spaced from the roller 18. The chute 24 particles typically have a particle size greater than 100 mesh. Particles with highly magnetic properties are held by the roller 18 to be collected in chute 26. If desired, another chute 28 and splitter 30 can be used to separate the catalyst particles into relatively more and less magnetic cuts. The more magnetic particles are thus collected in chute 28 and the non-magnetic particles are collected in chute 24.

The fractions then gravity flow into separate catalyst transporters. The least magnetic or recycle from chute 28 is returned to the regenerator while the most magnetic or reject from chute 26 is transferred to the spent hopper along with the >100 mesh size particles from chute 24.

An incidental benefit of removing this inert material is the removal of a majority of the coarse material in the ECat. By coarse, we mean that the material has a particle size greater than 176 microns (100 mesh). This material is difficult to fluidize in the FCC unit. If a bad batch of catalyst were received from a manufacturer with significant amounts of particles of this size or larger, the smooth operation of the plant would be jeopardized.

In many units iron content, and/or nickel and vanadium content, varies seasonally with the amount of heavy material fed to the cracker. It is beneficial to at least periodically analyze metal content in the feed and adjust operation of the magnetic separation unit accordingly so that a relatively constant amount of material is rejected as too magnetic. The magnetic separation unit is itself a fairly a good indicator of metals level, and belt speed can be adjusted as needed to maintain the desired ratio of reject/recycled catalyst.

COMPARATIVE EXAMPLE 1

The example of the invention in U.S. Pat. No. 5,250,482 reported the data reproduced in Table 1 below from magnetic catalyst beneficiation in an FCC unit wherein the low susceptibility, low activity catalyst was allegedly passivated and returned to the FCC unit.

TABLE 1

Open Gradient Magnetic Separation Test Results. All metals reported in ppm.

| | Ni | V | Fe | Cu |
|---|---|---|---|---|
| Low Susceptibility Low Activity | 720 | 1,110 | 7,200 | 70 |
| High Susceptibility High Activity | 860 | 1,490 | 7,400 | 60 |

Rendering these numbers in "nickel equivalents" yields the following:

| | "Nickel Equivalents" (ppm) |
|---|---|
| Low Susceptibility Low Activity | 2,022 |
| High Susceptibility High Activity | 2,261 |

The '482 patent reports that a low-activity (low-metal) catalyst produced 42.51% gasoline, while a high-activity catalyst produced 45.46% gasoline.

COMPARATIVE EXAMPLE 2

Prior to employing magnetic separation in an FCC unit, a catalyst sample specimen was obtained and subjected to magnetic separation in a lab using a 3-inch rare earth roller magnetic separator (RERMS) with the radial magnets stretched in bucking configuration. The properties of the catalyst feed to the RERMS, and the magnetically separated most magnetic fraction, second most magnetic fraction, least magnetic fraction and non-magnetic fraction are presented in Table 2.

TABLE 2

CATALYST PROPERTIES

| | Feed | Most magnetic | 2nd most magnetic | Least magnetic | Non-magnetic |
|---|---|---|---|---|---|
| Magnetic Separation (wt %) | 100 | 54.7 | 6.5 | 37.6 | 1 |
| size (mesh) | | Particle Size Distribution | | | |
| 100+ | N/A | 1 | 8 | 1 | 99 |
| 150+ | N/A | 2 | 38 | 14 | 1 |
| 200+ | N/A | 32 | 38 | 51 | 0 |
| 325+ | N/A | 64 | 16 | 34 | 0 |
| 325− | N/A | 1 | 1 | 0 | 0 |
| Magnetic Susceptibility ($Xg \times 10^{-6}$ emu/g) | 21.6 | 37.3 | 17.1 | 12.9 | 8.8 |
| Metal Content | | | | | |
| Nickel (wt %) | 0.22 | 0.25 | 0.23 | 0.21 | 0.10 |

TABLE 2-continued

| CATALYST PROPERTIES | Feed | Most magnetic | 2nd most magnetic | Least magnetic | Non-magnetic |
|---|---|---|---|---|---|
| Iron (wt %) | 0.84 | 0.93 | 0.79 | 0.74 | 0.61 |
| Vandium (wt %) | 0.57 | 0.62 | 0.58 | 0.52 | 0.34 |

The data in Table 2 illustrate the relatively coarse nature (>100 mesh) of the inert, non-magnetic compared to the magnetic fraction.

EXAMPLE 1

A commercial FCC unit operating without magnetic separation was modified for operation with magnetic separation of catalyst from the regenerator. A rare earth magnetic separator was used with 3-inch magnets arranged in a bucking configuration (SNNSSN etc.) and a 5 mil KEVLAR belt. The relative proportions of the least magnetic fraction (recycled to the regenerator), the most magnetic fraction (discarded) and the inert, nonmagnetic fraction are presented in Table 3.

TABLE 3

MAGNETIC SEPARATION OF FCC CATALYST

| Month of Operation | Total Catalyst Processed, Tons | Least Magnetic Recycle, Tons (wt %) | Most Magnetic Discard, Tons (wt %) | Non-Magnetic Discard, Tons (wt %) |
|---|---|---|---|---|
| 1 | 63 | 40 (63.2) | 21 (32.8) | 2 (4.0) |
| 2 | 168 | 119 (70.7) | 46 (27.2) | 3 (2.1) |
| 3 | 150 | 108 (72.0) | 40 (26.6) | 2 (1.4) |
| 4 | 225 | 197 (87.5) | 25 (11.0) | 3 (1.5) |
| 5 | 233 | 192 (82.5) | 39 (16.6) | 2 (0.9) |
| Total | 839 | 656 (78.2) | 17 (20.4) | 12 (1.4) |

The data in Table 3 show that the inert and most magnetic fraction were greatest when the FCC unit was initially put on stream for RERMS processing of the catalyst from the regenerator. As operation progressed, the non-magnetic discard fraction dropped to 1–2% after several months, while the most magnetic discard fraction was initially more than 30% and dropped to 10–20%. A sample of the non-magnetic discard showed an MAT gasoline conversion of 10.7 volume percent, a nickel content of 1004 ppm, vanadium content of 812 ppm, and an iron content of 15,438 ppm, thus confirming that the material was inert.

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein.

We claim:

1. A process for fluidized catalytic cracking (FCC) of a metals-contaminated hydrocarbon feed to lighter products comprising the steps of:

a) mixing a metals-contaminated, crackable hydrocarbon feed with a source of hot regenerated catalyst in a cracking reaction zone of an FCC unit to produce a mixture of cracked products and spent catalyst-containing metals deposited on the catalyst during the cracking reaction;

b) separating the spent catalyst from the cracked products;

c) removing the cracked products from the FCC process;

d) stripping the spent catalyst in a catalyst stripping zone by contact with stripping vapor to remove strippable hydrocarbons from the spent catalyst and produce stripped catalyst;

e) regenerating the stripped catalyst at catalyst regeneration conditions by contact with oxygen or an oxygen-containing gas to produce regenerated, metals-contaminated catalyst which is recycled to the cracking reaction zone;

f) recirculating the catalyst through steps (a) through (e) for an average residence time effective to build up a metals content in active catalyst particles so that a majority of the active catalyst has an intermediate to low metals content;

g) at least periodically removing a fraction of catalyst particles from the FCC unit and replacing the removed fraction with catalyst comprising a majority of catalytically active particles and a minority of relatively inert particles having less than 1/10th the cracking activity of the active catalyst;

h) magnetically separating the removed fraction into:

1) a high-metals fraction containing a relatively high-metals catalyst fraction which is removed from the unit and discarded;

2) an intermediate to low metals fraction which is recycled to the unit; and 3) an inert fraction having a particle size distribution greater than 100 mesh which is removed from the unit and discarded.

2. The process of claim 1 wherein the inert fraction and the high-metals fraction are essentially free of active catalyst and comprise at least 80 percent of the inactive particles in the removed catalyst fraction in step (g).

3. The process of claim 1 wherein at least a majority of the said inert fraction has a particle size in excess of 176 microns.

4. The process of claim 1 wherein the high metals fraction which is discarded has a total nickel and vanadium content of at least 6000 ppm, and the intermediate to low metals fraction has a lower metals content than the high metals discard fraction.

5. The process of claim 1 wherein said intermediate fraction is recycled directly to the FCC unit.

6. The process of claim 1 wherein the high metals fraction and the inert fraction are combined to form a discard fraction comprising a mixture of the high metals fraction and the inert fraction.

7. The process of claim 6 wherein the discard fraction is pneumatically transported to a catalyst disposal means.

8. The process of claim 1 wherein the average residence time of the recirculating catalyst is at least 5 days.

9. The process of claim 1 wherein the average residence time of the recirculating catalyst is between 10 and 30 days.

10. In a process for fluidized catalytic cracking (FCC) of a metals-contaminated hydrocarbon feed to lighter products comprising the steps of (a) mixing a metals-contaminated, crackable hydrocarbon feed with a source of hot regenerated catalyst in a cracking reaction zone to produce a mixture of cracked products and spent catalyst containing metals deposited on the catalyst during the cracking reaction, (b) separating the spent catalyst from the cracked products, (c) removing the cracked products from the process, (d) stripping spent catalyst in a catalyst stripping zone by contact with stripping vapor to remove strippable hydrocarbons from the spent catalyst and produce stripped catalyst, (e) regenerating the stripped catalyst at catalyst regeneration conditions by contact with oxygen or an oxygen-containing gas to produce regenerated, metals-contaminated catalyst which is recycled to the cracking reaction zone, (f) recirculating the catalyst in the FCC unit for an average residence time, (g) at least periodically removing a fraction of catalyst particles from the FCC unit and replacing the removed fraction with catalyst comprising a majority of catalytically active particles and a minority of relatively inert particles having less than 1/10th the cracking activity of the active catalyst, and (h) magnetically separating the removed fraction into (i) a high-metals fraction containing a relatively high-metals catalyst fraction which is removed from the unit and discarded and (ii) an intermediate to low metals fraction which is recycled to the unit, the improvement wherein:

(1) the residence time in the recirculating catalyst in step (f) is effective to build up a metals content in active catalyst particles so that a majority of the active catalyst has an intermediate to low metals content;

(2) the intermediate to low metals fraction is recycled to the FCC unit without further treatment; and (3) step (h) magnetically separates an inert fraction having a particle size greater than 100 mesh which is removed from the unit and discarded.

11. The improvement of claim 10 wherein the inert fraction and the high-metals fraction are essentially free of active catalyst and comprise at least 80 percent of the inactive particles in the removed catalyst fraction in step (g).

12. The improvement of claim 10, further comprising combining the high-metals fraction and the inert fraction to produce a discard fraction of mixed high metals and essentially metals-free material.

13. The improvement of claim 12, further comprising pneumatically transporting the discard fraction to a catalyst collection/disposal means.

14. The improvement of claim 10 wherein at least the majority of the inert fraction has a particle size in excess of 176 microns.

15. The improvement of claim 10 wherein the high metals fraction has a total nickel and vanadium content from 1,500 to 15,000 ppm, and the intermediate to low metals fraction has a lower metals content than the high metals discard fraction.

16. The improvement of claim 10 wherein the high metal fraction has a total nickel and vanadium content of at least 4,000 ppm, and the intermediate to low metals fraction has a lower metals content than the high metals discard fraction.

17. The improvement of claim 15 wherein said intermediate fraction is immediately and continuously recycled to the FCC unit.

18. The improvement of claim 16 wherein said intermediate fraction is immediately and continuously recycled to the FCC unit.

19. The improvement of claim 10 wherein the average residence time in step (f) is at least 5 days.

20. The improvement of claim 10 wherein the average residence time in step (f) is between 10 and 30 days.

* * * * *